United States Patent [19]

Hutchinson et al.

[11] 4,373,685

[45] Feb. 15, 1983

[54] STRAND CARRIER

[75] Inventors: George M. Hutchinson, Hartwell, Ga.; Robert L. Burchette, Jr., Spartanburg, S.C.

[73] Assignee: LHP Corporation, Hartwell, Ga.

[21] Appl. No.: 218,005

[22] Filed: Dec. 18, 1980

[51] Int. Cl.[3] ..... B65H 75/14

[52] U.S. Cl. ..... 242/118.6

[58] Field of Search ..... 242/46.2, 46.21, 68.6, 242/118.4, 118.6, 118.61, 118.7, 118.31, 118.32

[56] References Cited

U.S. PATENT DOCUMENTS

| | | | |
|---|---|---|---|
| 2,583,995 | 1/1952 | Burlein | 242/118.6 |
| 3,501,110 | 3/1970 | Hopgood et al. | 242/118.7 |
| 3,650,494 | 3/1972 | Hutchinson | 242/118.61 |

*Primary Examiner*—Leonard D. Christian

*Attorney, Agent, or Firm*—Wellington M. Manning, Jr.; Luke J. Wilburn, Jr.

[57] ABSTRACT

An improved strand carrier that may be employed in an elastic yarn covering operation at rotational speeds in excess of 18,000 revolutions per minute. The carrier includes a barrel with a head or flange secured to at least one end of the barrel. An insert is secured within an end of the barrel and defines a spindle receiving opening therealong, at least the surfaces of which that are contactable by the spindle when received therein being of a thermoplastic polymeric material that is resistant to high temperatures and to creep. The insert may include a body portion and a polymeric bushing molded thereto. Mineral filled phenylene sulfide resins are preferred for manufacture of the spindle contactable surface.

9 Claims, 6 Drawing Figures

STRAND CARRIER

BACKGROUND OF THE INVENTION

The present invention is related to a carrier for receiving a yarn or strand therearound, particularly in a high speed covering operation, for example generally in excess of 18,000 and as high as 26,000 revolutions per minute.

In the textile and related industries, various machines and processes are utilized in which a continuous length of yarn or strand is processed and thereafter wound around a yarn carrier for storage or preparation for further processing. Historically in such processes in which a package of yarn is produced around a yarn carrier, much emphasis has been placed on the speed at which the machines operate and proper handling of the yarn in such fashion that the yarn package produced around the carrier is created with precision.

In carrying out the yarn handling process, the carrier is placed over a driven spindle with the yarn being wound therearound by rotation of the spindle. The speed of operation of the process is thus primarily controlled by the rate of rotation of the spindle. Proper placement of the carrier on the spindle is important to achieve a precision wind. Misalignment of the carrier about the spindle will create not only an improperly wound yarn package, but oftentimes due to the high rotational speed of the spindle, excessive heat is generated between the spindle and the prior art carriers such that bushings within the carrier experience dimensional charge, particularly when the bushings are manufactured of synthetic polymeric materials. Shrinkage of the bushing for example, can cause the carrier to become jammed on the spindle requiring forceable removal of same which could lead to damage to the carrier and/or the spindle. Additionally, production time is lost and in general an adverse condition exists.

In certain of the processing operations, extremely high speeds are encountered, for example upwards of 18,000 and as high as 26,000 spindle revolutions per minute. For such high speeds, proper placement of the carrier around the spindle becomes particularly important. An improperly manufactured carrier, or a carrier manufactured from materials that will not withstand the rigors of high rotational speed, and/or misalignment may create very extreme adverse conditions. A misaligned carrier rotating at high speed can create noise levels that greatly exceed the standards established by OSHA as can the use of certain materials in the manufacture of a carrier. Furthermore, carriers which are not concentric within close tolerances and thus out of dynamic balance can create excessive vibration which of course abets the noise problem, as well as leading to potential vibration damage to the carrier and/or the processing equipment. Still further, high speed spindles often employ O-rings spaced along the length of same which better maintain a driven relationship between the spindle and an inside wall of the yarn carrier to prevent relative movement therebetween. Relative movement between the spindle assembly and the carrier could lead to an improper production of a yarn package or create excessive heat which could cause the carrier to become tightly secured around the spindle or if certain materials are employed, welded to the "O" rings. A high speed yarn covering operation where cover yarns are wrapped around an elastic core is such a processing operation.

In such processes as described above, it is also important that the yarn carrier be free of superficial defects that could snag or otherwise damage the yarn being wound therearound. Accordingly, certain of the prior art carriers have been manufactured from aluminum or other lightweight metals which may be anodized to present a smooth surface on the carrier which enables the carrier to receive yarn therearound without damaging the yarn. Bushings are received within some of these yarn carriers for direct contact with the spindle and such bushings in the prior art have been manufactured of metal or certain synthetic polymeric materials. The bushings are generally separate inserts that, following formation of same, are press fit or adhesively secured within the barrel of the yarn carrier. Metal bushings have the inherent fault of creating excessive noise levels as well as leading to greater expense for the part. Synthetic polymeric bushings utilized prior to the present invention have also been fraught with problems in several areas. For example, these prior art synthetic polymeric materials have not possessed adequate thermal or dimensional stability, such that, if the carrier is anodized for example, the polymeric material shrinks during the anodizing process due to excessive heat. Subsequent to anodizing, the shrunk bushing must then be reamed to reachieve a proper inside diameter for fit about the spindle. This reaming operation generally alters the concentricity of the carrier. Misalignment of carriers along the spindle can also create problems where due to the high temperatures produced by frictional engagement between the O-rings and the misaligned bushing, whereby the bushing can become welded to the O-ring which rigidly secures the carrier to the spindle and requires a forceful removal of same.

In general, prior art carriers known to applicant have utilized metallic bushings such as brass and synthetic polymeric bushings, such as molded, macerated phenolics and mineral filled nylon, all of which possess the disadvantageous characteristics noted above. The present invention overcomes the disadvantages of the prior art and is not believed to be taught or suggested by same.

SUMMARY OF THE INVENTION

It is an object of the present invention to provide an improved yarn carrier which may be employed at high rotational speeds without significant dimensional change.

Another object of the present invention is to provide an improved yarn carrier that employs a bushing for receipt around a spindle that is both thermally and dimensionally stable.

Yet another object of the present invention is to provide an improved yarn carrier that utilizes an internal bushing that is unaffected by the temperatures and chemicals attendant to an anodizing process.

Still further another object of the present invention is to provide an improved aluminum yarn carrier that includes a synthetic polymeric bushing of a material that is dimensionally and thermally stable under use conditions incident to a high speed, precision winding process.

Generally speaking the improved carrier of the present invention comprises an elongate barrel, said barrel having an outside wall defining a strand receiving surface and an inside wall defining an axial opening therethrough; an enlarged head secured to at least one end of said barrel and defining an opening therein in communication with said barrel opening; an insert received in said axial opening of said barrel, said insert defining a spindle receiving opening therealong, at least the portion of said insert being contactable by said spindle when said carrier is received thereover being manufactured from a thermoplastic polymeric material that is resistant to temperatures at least as high as experienced at spindle rotational speeds of 18,000 revolutions per minute, and that is resistant to creep; and means to secure said insert within said barrel, whereby said strand carrier may be employed in an operation where a strand is wound therearound at speeds of at least 18,000 revolutions per minute without experiencing physical changes to said bushing.

More specifically, the improved yarn carrier of the present invention preferably includes an aluminum barrel with an aluminum flange or head secured to opposite ends of same. An insert is provided that is received through an opening in the flange and passes into the barrel, extending a portion of the length of same. The insert may be provided by a metallic sleeve having an outward flare adjacent an outer end of same to which is molded a synthetic polymeric material that is thermoplastic in nature, and which possesses adequate thermal and dimensional stability to withstand temperatures in the neighborhood of about 210° to about 220° F. Alternatively, the insert may include a body molded of a first polymeric material that is molded around a polymeric bushing, the polymeric bushing being resistant to high temperatures and to creep. In preferred embodiments, two components of the insert are interrelated during the molding operation to further composite strength of the insert. The metallic sleeve, for example, that forms a part of an insert may be provided with a plurality of openings extending through the side wall of same, whereby the polymeric material when molded to the sleeve encapsulates same along a portion of the length of same. In similar fashion in the embodiment where the body of the insert is molded around the bushing, the bushing may be provided with protuberances or detents for improved interrelation between the bushing and the body.

The insert, depending upon its manufacture, may be secured within the carrier barrel by various means. Exemplary of such securement means are an adhesive-friction fit arrangement and self-threading screws. When adhesive securement is employed, a concavity is preferably provided around the girth of the insert to serve as a reservoir for the adhesive. Likewise when screws or other fastening members are employed, the insert preferably has a plurality of axially extending slots to receive the fastening members in threaded engagement with both the insert and the inside wall of the barrel.

In a most preferred embodiment, the bushing material whether utilized as an insert or whether molded directly to the barrel and flange of the carrier, is molded from a polyphenylene sulfide thermoplastic resin that is filled with a mineral fiber, such as glass, preferably in an amount of around 40 weight percent.

DESCRIPTION OF THE PREFERRED EMBODIMENTS

Figure 1:
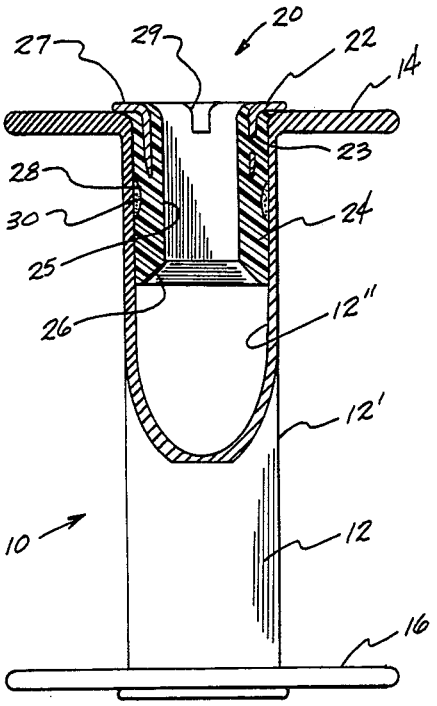
FIG. 1 is a side elevational view of a yarn carrier according to teachings of the present invention shown partially in cross section.

Referring to the Figures, preferred embodiments of the present invention will now be described in detail. In FIG. 1, there is shown a yarn carrier generally indicated as 10 that includes a barrel 12 with flanges 14 and 16 located at opposite ends of barrel 12. Barrel 12 provides an outer wall surface 12' around which yarn is wrapped and an inner wall surface 12'' through which a spindle of the yarn handling machine passes and around which the carrier 10 is to be properly positioned for receipt of the yarn package to be produced therearound. As illustrated in FIG. 1, the carrier may be of a unitary structure insofar as the flanges 14 and 16 in the barrel 12 are concerned. Alternatively, however, barrel 12 may be separate from flanges 14 and 16.

While the carrier of the present invention may be utilized for any yarn handling machine on which a package of yarn is to be produced around a yarn carrier, the primary thrust of the carriers of the present invention is to be utilized as EYS spools, which are small spools that are utilized to receive covering yarns therearound. The EYS spools with covering yarn wound therearound are utilized on covering machines at speeds of approximately 18,000 to 26,000 revolutions per minute. Under such stringent operating conditions, it is of course necessary that the bobbin or spool have minimal eccentricity to avoid the introduction of vibration to the yarn handling machine. Likewise, at such speeds, heat generated by friction can cause a spool or bobbin to distort and thus become out of alignment or thus become rigidly secured to the spindle around which the carrier 10 resides. It is thus very important that the spool or carrier 10 according to teachings of the present invention maintain its integrity insofar as concentricity is concerned, and likewise that the contact surfaces on the inside of the barrel 12 for receipt around the spindle (not shown) of the covering machine not create problems during operation.

As illustrated in FIG. 1, an insert generally indicated as 20 is received within an end of barrel 12 with a like insert received in an opposite end, though not shown. The purpose of the insert is to enable the manufacturer of the carrier 10 to construct same such that it will properly reside around a spindle on a yarn handling machine, while avoiding the introduction of vibration and while permitting easy placement and removal of the carrier 10 around the spindle before and after the yarn package is produced. Historically, the inserts of yarn carriers of the type being discussed have presented particular problems as discussed above. For example, certain metallic inserts have been utilized which not only are expensive to manufacture by machining techniques, but also are prone to create excessive noise at the high operational speeds involved, with the decibel level of the noise created being substantially in excess of the standards now set by OSHA. In order to avoid problems attendant to the metallic inserts, attempts have been made to manufacture polymeric inserts, as exemplified by macerated phenolics which, though representing some improvement in the noise problem are still fraught with disadvantage insofar as adequate dimensional stability is concerned. The particular problems of such polymeric inserts have been discussed hereinbefore.

Insert 20 of the carrier 10 according to the present invention represents an improvement over prior art inserts and is illustrated as a hybrid, one that includes a metallic body portion 22 around which is molded a synthetic polymeric bushing 24. Making particular reference to FIG. 1, insert 20 is shown having metallic body portion 22 extending only partially along the length of same and having at least one opening 23 received in a side wall of same that permits encapsulation of body 22 by the polymeric material during molding of bushing 24, whereby body 22 is firmly anchored within the polymeric bushing 24. In a most preferred situation, a plurality of openings 23 are spaced about the circumference of body 22 to enable polymeric material to pass therethrough at various circumferential positions. Insert 20, as illustrated in FIG. 1, is also provided with a central axially aligned opening 25 within bushing 24 which is dimensioned to properly receive a spindle of a yarn handling machine therethrough, and preferably with a chamferred opening 26 at an end of same to facilitate guiding of the spindle therethrough. An outer opposite end of insert 20 is provided with a flange 27 which is constituted by flared segments of both body 22 and bushing 24, whereby insert 20 may be press fit into the internal dimension of barrel 12 with flange 27 engaging a top portion of the flange 14 or 16 of carrier 10.

Insert 20 may be dimensioned to be press fit into carrier 10. In a preferred arrangement, however, securement means other than pure frictional engagement are preferred. In FIG. 1, for example, insert 20 is shown to have a concave medial segment 28 around its girth in which is received a mass of adhesive material 30 which would assist in bonding insert 20 to inner wall surface 12'' of barrel 12. By providing concave segment 28 along the length of insert 20, a reservoir for the adhesive is provided to preclude the possibility of wiping the adhesive away during pressing of the insert into an end of barrel 12. While any adhesive that will provide the required bond strength and will withstand rigors to which the carrier may be subjected, cyanoacrylate adhesives are preferred.

Figure 2:
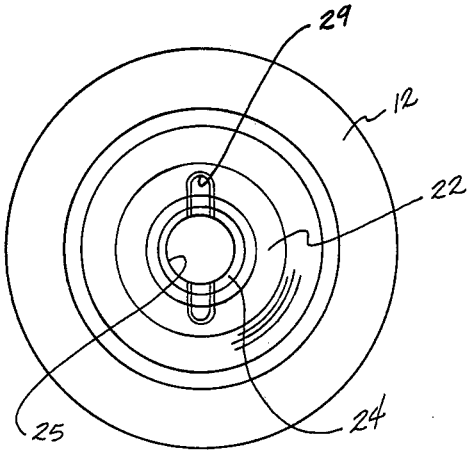
FIG. 2 is a top plan view of a yarn carrier as shown in FIG. 1.

As particularly illustrated in FIGS. 1 and 2, insert 20 may likewise be provided with a pair of oppositely located slots 29 located at flange 27 that extend radially outwardly from a center line through insert 24. Slots 29 provide recesses at an end of carrier 10 in which drive dogs or the like associated with the drive spindle may be received. Similarly, referring to FIG. 3, a carrier 110 is illustrated having a flange 114 and an insert 120 is made of a metallic body portion 122 and a polymeric bushing 124 as described with reference to FIG. 1. Differently from FIG. 2, however, insert 120 has a plurality of openings 129 received in an outer free end of same which extend partially along the length of insert 120, and in which driving means associated with the spindle may likewise be received.

Figure 3:
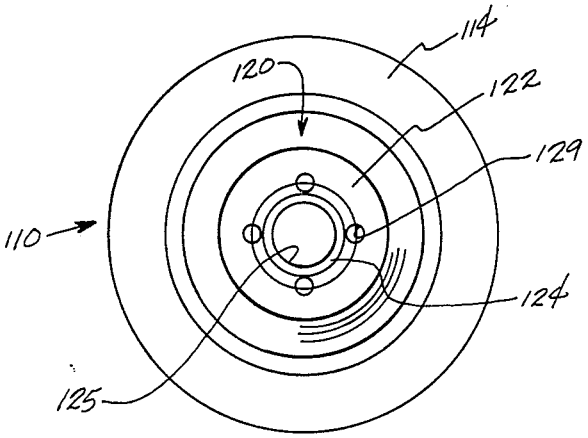
FIG. 3 is a top plan view of a yarn carrier of the type as shown in FIG. 1 illustrating a further embodiment of same.
Figure 4:
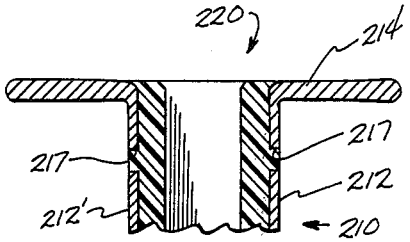
FIG. 4 is a further detailed section of an insert for the carrier of the present invention, shown in more detail.

FIG. 4 illustrates yet another embodiment of the present invention wherein a carrier generally indicated as 210 is provided having a barrel 212 of unitary construction with the flanges 214. While the full length of the carrier 210 is not illustrated in FIG. 4, the general structure of same at an opposite end would be like that as shown in FIG. 4. In FIG. 4, a plurality of openings 217 are located around the circumference of barrel 212 and an insert 220 is provided, wholly of synthetic polymeric material. Insert 220 is molded with the carrier located within the mold such that the polymeric material will flow into openings 217 along barrel 212 terminating at an outer surface 212' of same. Insert 220 is thus firmly and permanently secured to the carrier 210. In like fashion as shown in FIGS. 2 and 3, if desired, drive dog receiving elements may be provided at an outer end of molded insert 220.

In a preferred arrangement for the carrier of the present invention, the carrier body, that is, the barrel and flanges at the opposite ends, are manufactured of aluminum as well as is the metallic body portion 22 of the insert 20. Once the product is manufactured, it is properly machined to achieve close concentricity and carrier 10 may be thereafter subjected to an anodizing process to prepare the surface of the aluminum for receipt of a precision wound yarn package therearound. As mentioned above, synthetic polymeric thermoplastic materials have heretofore not been found suitable for use in a molded insert partially because the product will not undergo the temperatures sustained during anodizing, e.g., approximately 210° to 220° F. Furthermore it would not be practical subsequent to anodizing, to machine the carrier to close tolerances without the probability of damaging the anodized surface.

It has been determined that the aforementioned problems can be overcome by utilizing a synthetic polymeric material for at least the bushing of the insert that is thermoplastic in nature and which will resist dimensional change at temperatures associated with anodizing where the temperatures can reach 210° F. or higher. Such materials will likewise thereafter withstand the frictional heat generated during operation of the yarn carrier around a spindle of yarn handling machine, without dimensional change, or "welding" of the insert to an O-ring if one is utilized to position same about the spindle. While the present invention should not be so limited, a particularly good synthetic resinous material that is thermoplastic in nature and capable of being molded are the polyphenylene sulfide resins as exemplified by the Ryton resins manufactured by Phillips Chemical Company, Houston, Texas, which are mineral filled polyphenylene sulfide resins where the mineral ingredient is glass fiber preferably in an amount approximately 40% by weight.

Figure 5:
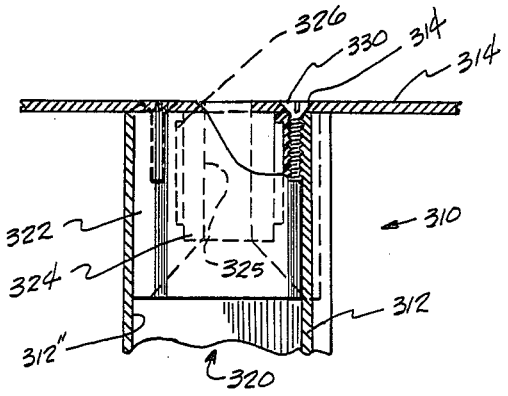
FIG. 5 is a partial elevational view of a carrier illustrating a further embodiment of an insert according to the present invention.
Figure 6:
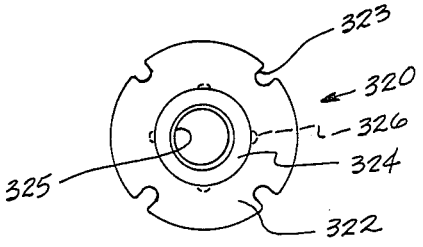
FIG. 6 is a top plan view of the insert as illustrated in FIG. 5.

Referring to FIGS. 5 and 6, a further embodiment of the present invention will be described in detail. An insert 320 is received within barrel 312 of a strand carrier generally 310. Insert 320 includes a molded bushing 324 around which is molded a polymeric body 322. Bushing 324 is made of a polymeric material that is resistant to high temperatures and to creep, and defines a spindle receiving opening 325 axially through same which serves as the contact surface with a spindle (not shown) of a yarn handling machine. As illustrated, bushing 324 is cylindrical in shape and has a plurality of axial ribs 326 located therearound and protruding outwardly therefrom. Polymeric body 322, which is preferably a different polymer from that for bushing 324, is molded about bushing 324 where greater composite strength is fostered by polymer of body 322 forming around ribs 326 of bushing 324. Molded body 322, as illustrated in FIG. 5, extends to an end of barrel 312 and is contacted by a flange or head 314 thereat. A plurality of axially extending slots 323 are provided about body 322 which, when received within barrel 312 are aligned with a like number of openings 314' in flange 314. Self threading fastening members 330 may then be screwed into the assembly with the fastening members self threading into insert body 322, within slots 323, and inside wall 312'' of barrel 312. In such fashion, barrel 312, insert 320, and head 314 are unitized. Preferably body 322 of insert 320 is manufactured from a mineral filled nylon while bushing 324 is manufactured from a mineral filled phenylene sulfide.

Having described the present invention in detail, it is obvious that one skilled in the art will be able to make variations and modifications thereto witout departing from the scope of the invention. Accordingly, the scope of the present invention should be determined only by the claims appended hereto.

That which is claimed is:

1. An improved strand carrier comprising:

(a) a barrel, said barrel having an outside wall defining a strand receiving surface and an inside wall defining an axial opening therethrough;

(b) an enlarged head secured to at least one end of said barrel defining an opening in communication with said barrel opening, said head further having carrier receiving means thereon; and (c) a molded, mineral filled polymeric bushing received within said barrel and secured thereto, said polymeric bushing defining a spindle receiving opening therethrough and being high temperature and creep resistant whereby when said carrier is employed in an operation wherein a strand is wound around said carrier at speeds in excess of 18,000 revolutions per minute, without physical change to the bushing.

2. A strand carrier as defined in claim 1 wherein said bushing has a metal portion partially encapsulated therein, said metal portion having a flared flange extending beyond the end of said bushing and residing adjacent said enlarged head.

3. A strand carrier as defined in claim 2 wherein said bushing has a concave section around its outer circumference intermediate the length of same.

4. A strand carrier as defined in claim 2 wherein said bushing has drive element receiving means located at an outer end of same.

5. A strand carrier as defined in claim 4 wherein said bushing is adhesively secured within said barrel, said concave section providing a reservoir for said adhesive during press fitting of said bushing into said barrel.

6. A strand carrier as defined in claim 5 wherein the adhesive is a cyanoacrylate type adhesive.

7. A strand carrier as defined in claim 2 wherein said metal portion defines a plurality of openings therearound and wherein said polymeric material is a polyphenylene sulfide, said polymeric material passing through said openings to anchor said metal portion within said polymeric material.

8. A strand carrier as defined in claim 1 wherein said barrel defines at least one opening in a side wall of same, and wherein said bushing is secured within said barrel during molding of same, by polymeric material of said bushing flowing in said at least one opening in said barrel side wall.

9. An improved strand carrier for receiving a strand package therearound comprising:

(a) a barrel, said barrel having an outside wall defining a strand receiving surface therealong and an inside wall defining an axial opening therethrough;

(b) an enlarged head located at each end of said barrels, said heads defining a central opening therethrough, in communication with said opening through said barrel;

(c) an insert received in said barrel at each end of same, said inserts comprising a body extending partially along said barrel opening and a polymeric bushing molded to said body, said polymer being high temperature and creep resistant, and said bushing defining a spindle receiving opening therethrough, axial to said barrel opening; and (d) means to secured said insert within said barrel, whereby said carrier may be employed in an operation at rotational speeds in excess of 18,000 revolutions per minute without physical change to said bushing.

* * * * *

UNITED STATES PATENT AND TRADEMARK OFFICE

CERTIFICATE OF CORRECTION

PATENT NO. : 4,373,685

DATED : February 15, 1983

INVENTOR(S) : George M. Hutchinson and Robert L. Burchette, Jr.

It is certified that error appears in the above-identified patent and that said Letters Patent are hereby corrected as shown below:

Column 1, line 33, "charge" should read--change--.

Column 6, line 52, "approximately" should read--approximating--.

Column 8, claim 9 (d), line 41, "secured" should read--secure--.

Signed and Sealed this

*Nineteenth* Day of *April 1983*

[SEAL]

*Attest:*

GERALD J. MOSSINGHOFF

*Attesting Officer*

*Commissioner of Patents and Trademarks*